US006298593B1

(12) United States Patent
Vilims et al.

(10) Patent No.: US 6,298,593 B1
(45) Date of Patent: Oct. 9, 2001

(54) PICTURE FRAME ASSEMBLY AND RETAINER THEREFOR

(76) Inventors: Daniel Vilims, deceased, late of Downers Grove, IL (US); by Dorothy Vilims, legal representative, 5618 Dunham Rd., Downers Grove, IL (US) 60516

( * ) Notice: Subject to any disclaimer, the term of this patent is extended or adjusted under 35 U.S.C. 154(b) by 0 days.

(21) Appl. No.: 09/330,447

(22) Filed: Jun. 11, 1999

(51) Int. Cl.[7] ..... A47G 1/06

(52) U.S. Cl. ..... 40/768; 40/780; 40/790; 24/67.9; 24/563

(58) Field of Search ..... 40/768, 777, 780, 40/781, 790, 791; 24/67.9, 545, 563

(56) References Cited

U.S. PATENT DOCUMENTS

| | | | | |
|---|---|---|---|---|
| 1,382,513 | * | 6/1921 | Kelly | 24/545 |
| 2,581,843 | | 1/1952 | Edwards | 40/155 |
| 3,899,844 | | 8/1975 | Munn | 40/156 |
| 3,952,437 | | 4/1976 | Mitchell | 40/152.1 |
| 3,965,601 | | 6/1976 | Nielsen | 40/155 |
| 3,973,343 | | 8/1976 | Tolfsen | 40/152.1 |
| 4,037,342 | | 7/1977 | Bott | 40/209 |
| 4,045,898 | | 9/1977 | Reinhardt | 40/156 |
| 4,063,378 | | 12/1977 | Burke | 40/156 |
| 4,129,953 | | 12/1978 | Eckert | 40/156 |
| 4,142,726 | | 3/1979 | Anderson | 273/157 R |
| 4,176,481 | | 12/1979 | Sawyer | 40/156 |
| 4,177,590 | | 12/1979 | Tushner et al. | 40/156 |
| 4,349,974 | | 9/1982 | Rapayelian | 40/156 |
| 4,356,648 | | 11/1982 | Beaulieu | 40/155 |
| 4,368,584 | | 1/1983 | Logan | 40/152 |
| 4,391,053 | | 7/1983 | Anthony | 40/152 |
| 4,510,707 | | 4/1985 | Girard | 40/152 |
| 4,516,342 | | 5/1985 | Reim | 40/156 |
| 4,590,696 | | 5/1986 | Squitieri | 40/156 |
| 4,638,930 | * | 1/1987 | Blanchard | 24/545 X |
| 4,707,937 | | 11/1987 | Astolfi | 40/152.1 |
| 4,712,761 | | 12/1987 | Wassell | 248/475.1 |
| 4,802,294 | | 2/1989 | Baus | 40/155 |
| 4,993,126 | * | 2/1991 | Collins | 24/563 X |
| 4,998,363 | | 3/1991 | Vilims | 40/156 |
| 5,109,619 | | 5/1992 | Noggle | 40/152.1 |
| 5,524,370 | * | 6/1996 | Roy | 40/768 X |
| 5,659,990 | | 8/1997 | Henneman et al. | 40/795 |
| 5,659,991 | * | 8/1997 | Kennedy | 40/777 X |

FOREIGN PATENT DOCUMENTS

| | | |
|---|---|---|
| 2225940 | 12/1973 | (DE) . |
| 2637144 | 3/1977 | (DE) . |
| 2057870 | 4/1981 | (GB) . |
| 2095990 | 10/1982 | (GB) . |

* cited by examiner

*Primary Examiner*—Brian K. Green
*Assistant Examiner*—James M Hewitt
(74) *Attorney, Agent, or Firm*—Thomas R. Vigil

(57) ABSTRACT

The frame assembly for mounting a picture, painting, photograph or the like includes: a generally rectangular frame having an inwardly extending rear end flange; a backing board having a border or perimeter and being constructed and arranged to be received within the frame; at least two retainers slidably mounted on the backing board and being movable from a position not engaging the rear end flange of the frame and within the border of the backing board to a rear end flange engaging position where a hook of the retainer at a first end of the retainer is positioned beyond the border of the backing board and in front of the rear end flange for holding the backing board in the frame of the frame assembly.

11 Claims, 2 Drawing Sheets

PICTURE FRAME ASSEMBLY AND RETAINER THEREFOR

BACKGROUND OF THE INVENTION

1. Field of the Invention

The present invention relates to a picture frame assembly and a retainer for holding a backing board for a picture or photograph in a frame.

More specifically, the present invention relates to a picture frame assembly including a retainer which is slidably mounted on a specifically constructed backing board, between a frame engaging position and a non-frame engaging position.

2. Description of the Prior Art

Heretofore, a number of different picture frame assemblies and retainers for use therein, have been proposed. Examples of these previously proposed picture frame assembles and retainers for use therein are disclosed in the following U.S. and foreign patents.

| U.S. Pat. No. : | PATENTEE |
|---|---|
| 2,581,843 | Edwards |
| 3,899,844 | Munn |
| 3,952,437 | Mitchell |
| 3,965,601 | Nielsen |
| 3,973,343 | Tolfsen |
| 4,037,342 | Bott |
| 4,045,898 | Reinhardt |
| 4,063,378 | Burke |
| 4,129,953 | Eckert |
| 4,142,726 | Anderson |
| 4,176,481 | Sawyer |
| 4,177,950 | Tushner, et al. |
| 4,368,584 | Logan |
| 4,349,974 | Rapayelian |
| 4,356,648 | Beauliu |
| 4,391,053 | Anthony |
| 4,510,707 | Girard |
| 4,516,342 | Reim |
| 4,590,696 | Squitieri |
| 4,707,937 | Astolfi |
| 4,712,761 | Wassell |
| 4,802,294 | Baus |
| 4,998,363 | Vilims |
| 5,109,619 | Noggle |
| 5,659,990 | Henneman et al. |
| GERMAN PATENT PUBLICATIONS | |
| German Patent Pub. No.: | PATENTEE |
| 2,225,940 | Rumland |
| 2,637,144 | Grünecker et al. |
| UNITED KINGDOM PATENT PUBLICATIONS | |
| U.K Patent Specification No.: | PATENTEE |
| 2,057,870 | Schafheutle |
| 2,095,990 | Skinner et al. |

SUMMARY OF THE INVENTION

According to the present invention there is a frame assembly for mounting a picture, painting, photograph or the like including: a generally rectangular frame having an inwardly extending rear end flange; a backing board having a border or perimeter and being constructed and arranged to be received within the frame; at least two retainers slidably mounted on the backing board and being movable from a position not engaging the rear end flange of the frame and within the border of the backing board to a rear end flange engaging position where a hook of the retainer at a first end of the retainer is positioned beyond the border of the backing board and in front of the rear end flange for holding the backing board in the frame of the frame assembly.

DESCRIPTION OF THE PREFERRED EMBODIMENTS

Figure 1:
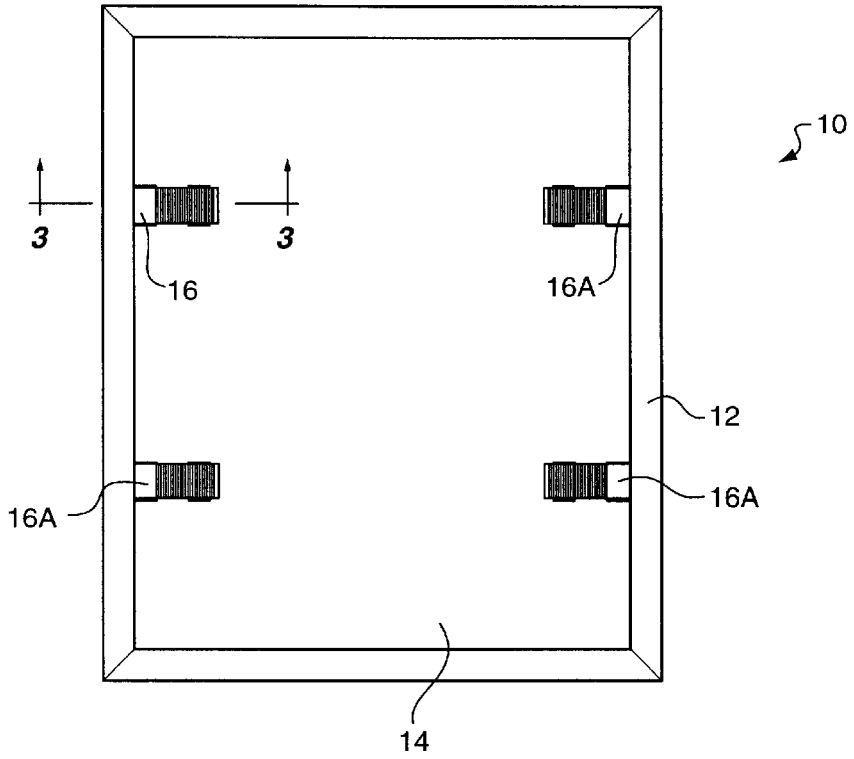
FIG. 1 is a back plan view of the picture frame assembly of the present invention and shows one of four retainers in a non-frame engaging position.

Referring now to FIG. 1, there is illustrated therein, a back plan view of picture frame assembly 10 which is constructed according to the teachings of the present invention. As shown, the picture frame assembly 10 includes a generally rectangular frame 12, a picture backing board 14, and four retainers 16, 16A.

As shown, each retainer 16, 16A is slidable laterally from an outward engaging position, shown by the retainer 16 in FIG. 1, where a short end flange or hook 18 of the retainer 16 engages behind a rear end flange 20 of the frame 12, and to a non-engaging position, as shown by the retainers 16A in FIG. 1.

Figure 2:
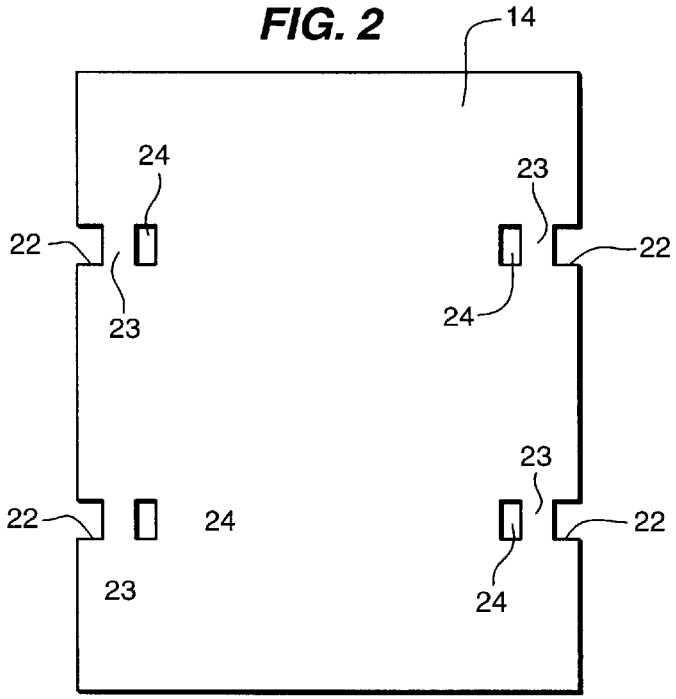
FIG. 2 is a plan view of the backing board without retainers mounted thereon.

As shown in FIG. 2 the backing board 14 is provided on each side edge with at least one notch 22 and then inwardly spaced from the notch 22 across a leg 23 of backing board 14 is an opening 24. Preferably, the notch 22 is generally rectangular in shape as is the opening 24 generally rectangular in shape. The notch 22 and the opening 24 facilitate mounting and sliding of the retainer 16 on the backing board 14.

Figure 3:
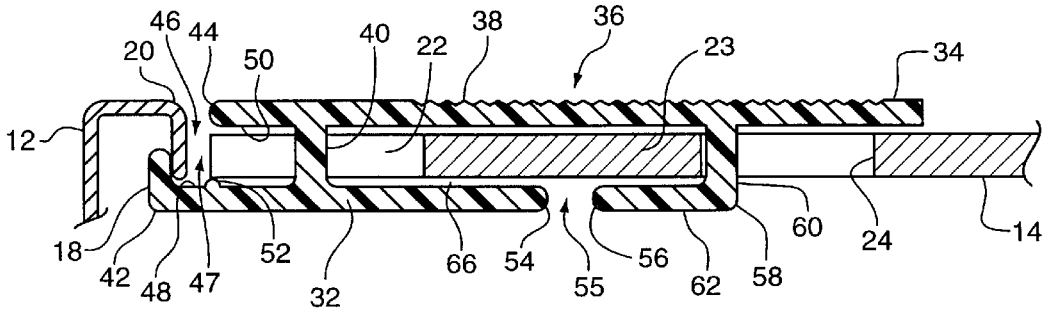
FIG. 3 is a sectional view of a portion of the frame backing board and retainer and is taken along line 3—3 of FIG.1.
Figure 4:
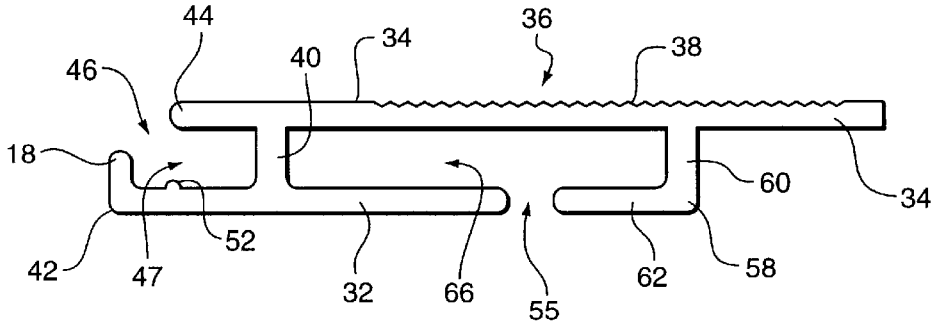
FIG. 4 is a sectional view, similar to the view shown in FIG. 3, but showing the retainer alone.

As best shown in FIGS. 3 and 4, each retainer 16 is a generally elongate, metal or plastic piece having an inner plate portion 32 and a spaced outer plate portion 34.

As shown, the outer plate portion 34 is continuous and has an outer engaging surface 36 which can be defined by a roughened area or as shown in the illustrated embodiment, a plurality of closely spaced parallel ribs 38, which will enable one to engage the retainer with a finger or a thumb for sliding it back and forth from the non-engaging position shown by retainers 16A to the frame engaging position shown by retainer 16.

As shown in FIGS. 3 and 4, the inner plate portion 32 is shorter than the outer plate portion 34 and is connected to the outer plate portion by a wall or webbing 40.

The inner short plate portion 32 extends from the wall 40 for roughly 35% of its length to an outer end 42 where the short end flange or hook 18 extends a short distance toward the outer plate portion 34. Note that an outer end 44 of the outer plate portion does not extend laterally as far as the outer end 42 of the inner plate portion 32 thereby to form a mouth or opening 46 which enables the hook 18 to extend behind (in front of) the rear end flange 20 of the frame 12.

A space 47 is formed between the wall 40, the hook 18, an inner surface 48 of the inner plate portion 32 and an inner surface 50 of the outer plate portion 34 for receiving a part of the rear end flange 20. A lateral or transverse rib 52 on the inner surface 48 limits or marks the extent of movement of the retainer 16, 16A against the rear end flange 20.

The shorter inner plate portion 32 extends for roughly 65% of its length inwardly from the wall 40 to an inner end 54 which is spaced by a gap or space 55 from an outer end 56 of an L-shaped wall 58 that extends inwardly through a first leg 60 from the inner surface 50 of the outer plate portion 34 to a second leg 62 that extends parallel to the outer plate portion 34 and in line with the inner plate portion to the outer end 56.

The space 55 between the ends 54 and 56 enables the retainer 16, to be mounted about the leg 23 of the backing board 14 which is received in a space 66 defined between the inner surface 50 of the outer plate portion 34, the wall 40, the leg 60, the leg 62 and the inner plate portion 32.

In use, the inner plate portion 32 of the retainer 16 can be pulled back by engaging the outer end 54 and pulling the inner plate portion 32 so as to widen the gap or space 55 between the end 54 of inner plate portion 32 and the end 56 of the L-shaped wall 58, thereby to facilitate insertion of the leg 23 into the space 66 and of the inner plate portion 32 on the inside of the leg 23 of the backing board 14. The leg 62 of the L-shaped wall 58 is about the same size, but slightly smaller than the opening 24 and snaps into the opening 24 as the retainer 16 is moved inwardly of the backing board 14. The retainer 16 can now be pushed laterally toward the outer edge of the backing board 14 thereby to position the L-shaped wall 58, e.g., leg 62, around the leg 23 of material of the backing board 14 between the opening 24 and the notch or slot 22. Then the hook 18 at the outer end of the inner plate portion 32 is positioned to engage the flange 20 of the frame 12, as shown in FIG. 3.

It will be noted that the width of the leg 23 in the backing board 14 is less than the width of the space 47 thereby to permit sliding movement of the retainer 16 from an inner non-frame engaging position, shown at 16A to an outer frame-engaging position, shown at 16.

It will be apparent that when the retainer 16 is moved to the outer flange engaging position, the hook 18 is in position to engage the rear flange 20 of the frame 12 thereby to hold the backing board 14 within the frame 12 and as a result hold a picture in the frame 12.

In one preferred embodiment of the picture frame assembly 10 of the present invention and of the retainer 16, 16A used therewith, the notch 22 was approximately ⅝ inch long or wide and approximately ⅜ inch deep into the edge of the board.

The webbing 23 was approximately ⅜ inch wide and approximately ⅝ inch long. The opening 24 was approximately ⅝ inch long or wide with a depth of approximately ⅜ inch.

As for the retainer 16, the outer plate portion 34 has a length of approximately 1⅜ inches, and the inner plate portion 32 has a length of approximately ¾ inch. The distance between the plate portions 32 and 34 is approximately ⅛ inch. The length of the end flange or hook 18 is approximately ⅛ inch. The distance between the wall 40 and the leg 60 of the L-shaped wall 58 is approximately ¾ inch.

The length of the leg 62 of the L-shaped wall 58 is approximately ¼ inch, and the gap or space 55 is approximately 1/16 inch prior to the bending of the outer plate portion 34 for flexing the ends 54 and 56 away from each other.

From the foregoing description, it will be apparent that the picture frame assembly 10 of the present invention and the retainer 16, 16A for use therewith, have a number of advantages, some of which have been described above and others of which are inherent in the assembly 10 and the retainer 16, 16A.

The retainer 16 being accurately located and secured to the rigid back member or board 14 positively engages the frame 12. This added frame support effectively eliminates the frame distortion that is common to metal frames of narrow/contemporary profile design.

Furthermore, the use of the retainer 16, coupled with the use of a resilient securing and void filling material, allows the back member or board 14 to be located flush with the rear edge of the frame 12. This results in an improved "finished" appearance, similar to upscale frames featuring a "dust shield" used to conceal unfinished framing components and construction details.

Also, it will be understood that modifications can be made to the frame assembly 10 and to the retainer 16, 16*a* used therewith, without departing from the teachings of the invention. Accordingly, the scope of the invention only is to be limited as necessitated by the accompanying claims.

I claim:

1. A frame assembly for mounting a picture, painting, or photograph comprising:

a generally rectangular frame having an inwardly extending rear end flange;

a backing board having a border and being constructed and arranged to be received within said frame;

at least two retainers slidably mounted on said backing board and being movable from a position not engaging said rear end flange of said frame and within said border of said backing board to a rear end flange engaging position where a hook of each said retainer at a first end of each said retainer is positioned beyond said border of said backing board and in front of said rear end flange for holding said backing board in said frame of said frame assembly, opposite sides of said border of said backing board each including at least one notch formed therein and, formed inwardly from each said notch, an opening, and said backing board having a leg of material disposed between each of said notch and each opening and each said retainer including spaced inner and outer plate portions and a wall interconnecting said plate portions, said wall being spaced from said hook at said first end of each said retainer for being received in a respective notch in said backing board.

2. The frame assembly of claim 1 wherein each said retainer includes an L-shaped wall which extends inwardly from said second outer plate portion, which is located between said wall and a second end of said retainer and which is constructed and arranged to extend through said opening such that a first leg of the L-shaped wall extending from the outer plate portion extends through said opening and a second leg of said L-shaped wall extends behind and generally parallel to an inner side of said backing board and is movable to a position behind said first leg on said backing board.

3. The frame assembly of claim 2 wherein said second end of said retainer is an end of said outer plate portion which is located beyond said first leg of said L-shaped wall L, said first end of said retainer being at a first end of said inner plate portion and said second leg of said L-shaped wall being in line with said inner plate portion and extending to an outer end of said second lea which is spaced from a second end of said inner plate portion to form a gap, said gap being expanded by flexing said outer plate portion to facilitate mounting of said retainer on said leg of material of said backing board.

4. The frame assembly of claim 1 wherein said inner plate portion extends to an outer end having said hook extending laterally therefrom and defining said first end of said retainer and said outer plate portion has an end which does not extend to said first end so as to form an opening or gap at said first end of said retainer for receiving said rear end flange of said frame.

5. The frame assembly of claim 1 wherein said outer plate portion has a roughened surface to facilitate engagement thereof by a thumb or finger for sliding the retainer back and forth between the non-engaging position and the rear end flange engaging position.

6. A retainer for use in a frame assembly, said retainer comprising spaced inner and outer plate portions, a hook at a first end of said retainer and a wall interconnecting said plate portions, said wall being spaced from said hook at said first end of said retainer and being constructed and arranged to be received in a notch in a backing board, an L-shaped wall which extends inwardly from said second outer plate portion, which is located between said wall and a second end of said retainer and which is constructed and arranged to extend through an opening in a backing board such that a first leg of the L-shaped wall extending from the outer plate portion extends through the opening and a second leg of said L-shaped wall extends behind and generally parallel to an inner side of the backing board and is movable to a position behind a leg of material of the backing board.

7. The retainer of claim 6 wherein said inner plate portion extends to an outer end having said hook extending laterally therefrom and defining said first end of said retainer and said outer plate portion has an end which does not extend to said first end so as to form an opening or gap at said first end of said retainer for receiving a rear end flange of a frame of a frame assembly.

8. The frame assembly of claim 6 wherein said outer plate portion has a roughened surface to facilitate engagement thereof by a thumb or finger for sliding the retainer back and forth from a non-end frame flange engaging position within a border of a backing board and a rear end flange engaging position where said hook of said retainer extends beyond one side edge of the backing board.

9. A retainer for use in a frame assembly, said retainer comprising spaced inner and outer plate portions and having a first end and a second end, a hook at said first end of said retainer and a wall interconnecting said plate portions, said wall being spaced from said hook at said first end of said retainer and being constructed and arranged to be received in a notch in a backing board, said second end of said retainer being an end of said outer plate portion which is located beyond a first leg of an L-shaped wall, said first end of said retainer being at a first end of said inner plate portion and a second leg of said L-shaped wall being in line with said inner plate portion and extending to an outer free end which is spaced from a second end of said inner plate portion to form a gap, said gap being expanded by flexing said outer plate portion to facilitate mounting of said retainer on a leg of material of a backing board.

10. The retainer of claim 9 wherein said inner plate portion extends to an outer end having said hook extending laterally therefrom and defining said first end of said retainer and said outer plate portion has a free end which does not extend to said first end of said retainer so as to form an opening or gap at said first end of said retainer for receiving a rear end flange of a frame of a frame assembly between said hook and said free end of said outer plate portion.

11. The frame assembly of claim 9 wherein said outer plate portion has a roughened surface to facilitate engagement thereof by a thumb or finger for sliding the retainer back and forth from a non-end frame flange engaging position within a border of a backing board and a rear end flange engaging position where said hook of said retainer extends beyond one side edge of the backing board.

* * * * *